United States Patent [19]

Davis

[11] 4,018,072

[45] Apr. 19, 1977

[54] END RECORRUGATOR

[75] Inventor: Paul K. Davis, Alameda, Calif.

[73] Assignee: Pacific Roller Die Co., Inc., Hayward, Calif.

[22] Filed: Oct. 22, 1975

[21] Appl. No.: 624,675

[52] U.S. Cl. ..... 72/106; 72/110

[51] Int. Cl.[2] ..... B21D 19/04

[58] Field of Search ..... 72/105, 106, 107, 110

[56] References Cited

UNITED STATES PATENTS

| | | | |
|---|---|---|---|
| 1,205,605 | 11/1916 | Eligh | 72/106 |
| 1,463,073 | 7/1923 | Felten | 72/106 |
| 1,604,346 | 10/1926 | Grotnes | 72/106 |
| 2,809,687 | 10/1957 | Ogle | 72/105 |
| 3,548,623 | 12/1970 | Hess et al. | 72/106 |
| 3,662,579 | 5/1972 | Lewis | 72/105 |

*Primary Examiner*—Lowell A. Larson
*Attorney, Agent, or Firm*—Townsend and Townsend

[57] ABSTRACT

The present invention relates to machines for recorrugating the ends of a helically corrugated pipe. One end of the pipe is inserted between and engaged by a juxtaposed pair of recorrugating rollers. The rollers are mounted on shafts which are driven to recorrugate the end of the pipe. As an improvement in such machines, the present invention provides a rotatable annular thrust ring, the marginal portion of which passes between the shafts. At least a portion of the end of the pipe to be recorrugated is abutted against the thrust ring to prevent axial movement of the pipe as it is being recorrugated. The ring is allowed to rotate during the recorrugating process to minimize damage to the end of the pipe.

13 Claims, 17 Drawing Figures

END RECORRUGATOR

BACKGROUND OF THE INVENTION

The present invention relates to an apparatus and method for recorrugating the ends of a helically corrugated pipe in which damage to the ends of the pipe as it is being recorrugated is minimized.

It has long been known that corrugating the side walls of a steel pipe greatly increases its strength. Because of the manner in which such corrugations are formed in the side walls of the pipe, most pipe is helically corrugated, i.e., the corrugations run in a helical fashion along the side walls of the pipe. However, difficulties have been encountered in making water tight connections at the junction between such helically corrguated pipe sections. As a result of these problems, it has been found best to recorrugate the ends of such pipe so that the ends have annular corrugations to facilitate the making of watertight connections between adjacent sections of pipe.

Machines have been developed for recorrugating the ends of helically corrugated pipe so that the corrugations are annular. However, in such machines, it has been found that the helical corrugations act as threads to move the pipe in the directions of the corrugations and the pipe is not properly recorrugated. To counteract this effect, it has been found necessary to abut the ends of the pipe against a stationary thrust plate. However, the force exerted by the pipe on the thrust plate is relatively large, and the friction between the pipe and the thrust plate damages the ends of the pipe. In addition, it has been found that recorrugating both ends of the pipe in a single step doubles the force on the thrust plate and compounds the problem. Accordingly, the ends of the pipe must be recorrugated one at a time, greatly complicating the recorrugating procedure, and damage to the the pipe remains excessive.

The difficulties in recorrugating the ends of the helically corrugated pipe and the damage caused to such pipe in the recorrugating procedure necessarily degrades the quality of any junction which can be formed between adjacent pipe sections. As a result, the use of such recorrugated pipe is often looked on with disfavor where junctions are required between adjacent sections of pipe. In such situations concrete pipe is ordinarily used in place of recorrugated steel pipe even though the steel pipe may possess other advantages over such concrete pipe.

SUMMARY OF THE INVENTION

The present invention provides an improvement in machines for recorrugating the ends of a helically corrugated pipe. The end of the pipe to be recorrugated is inserted between and engaged by a juxtaposed pair of recorrugating rollers. The rollers are mounted on rotatable shafts which are driven to recorrugate the end of the pipe. As an improvement in such machines, the present invention provides a rotatable annular thrust ring having a marginal portion passing between the shafts. At least a portion of the end of the pipe to be recorrugated is abutted against the thrust ring. The ring is mounted so that axial movement of the ring is prevented so that the pipe cannot move axially with respect to the recorrugating rollers. However, the thrust ring is allowed to rotate so that the ring rotates with the pipe during the recorrugating process.

Because the annular thrust ring rotates with the pipe, the pipe does not slide along a thrust plate as in the prior art. Preventing such sliding substantially eliminates the damage to the end of the pipe which occurred with prior art devices. In addition, the use of the rotatable thrust ring permits the recorrugating of both ends of the pipe at the same time. Friction between the pipe and the thrust ring is reduced to such an extent that the double thrust which occurs when both ends of the pipe are being recorrugated at the same time can be counteracted without significant damage to the pipe.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
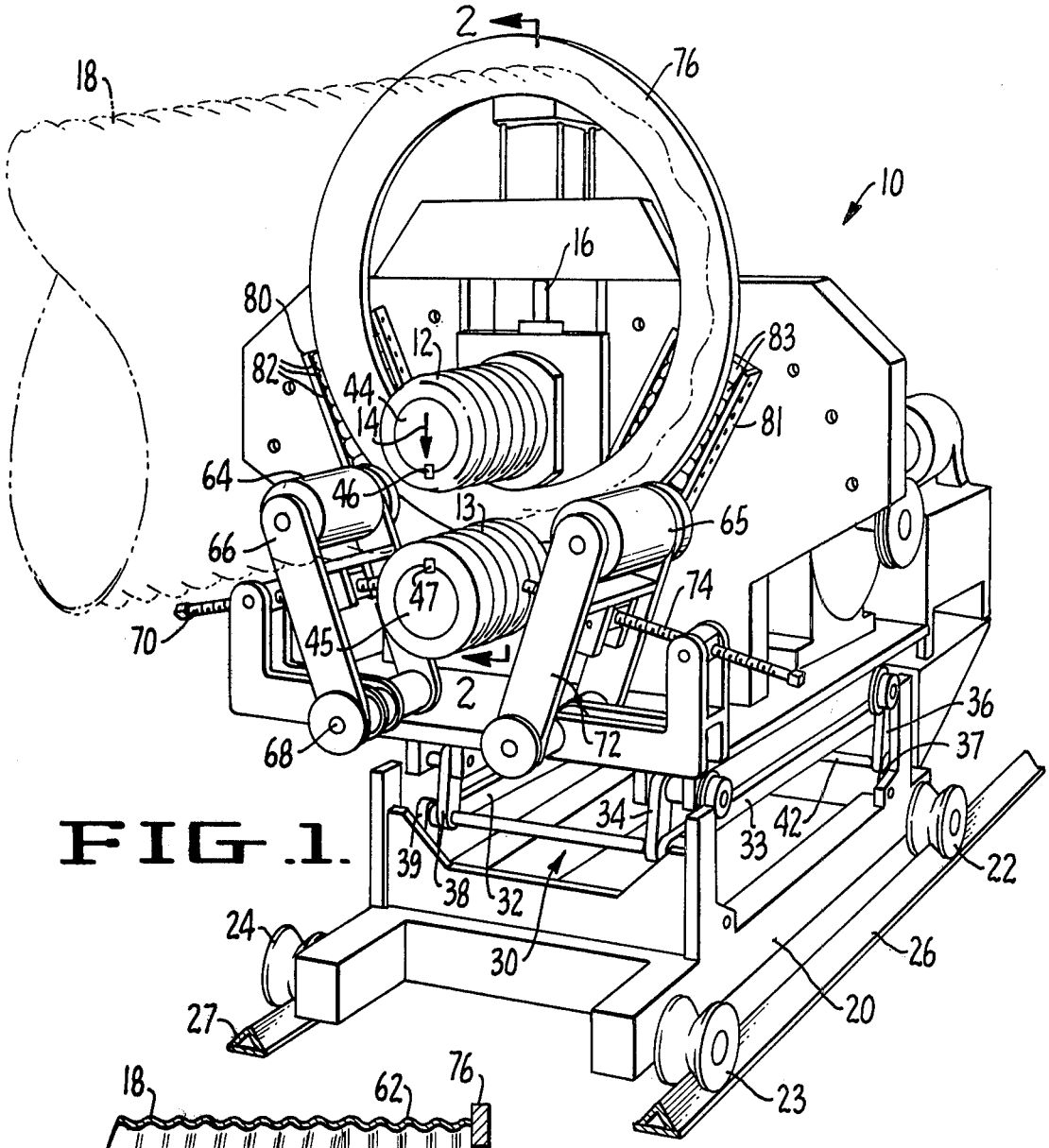
FIG. 1 is a perspective view of a recorrugating machine constructed according to the teachings of the present invention.
Figure 2:
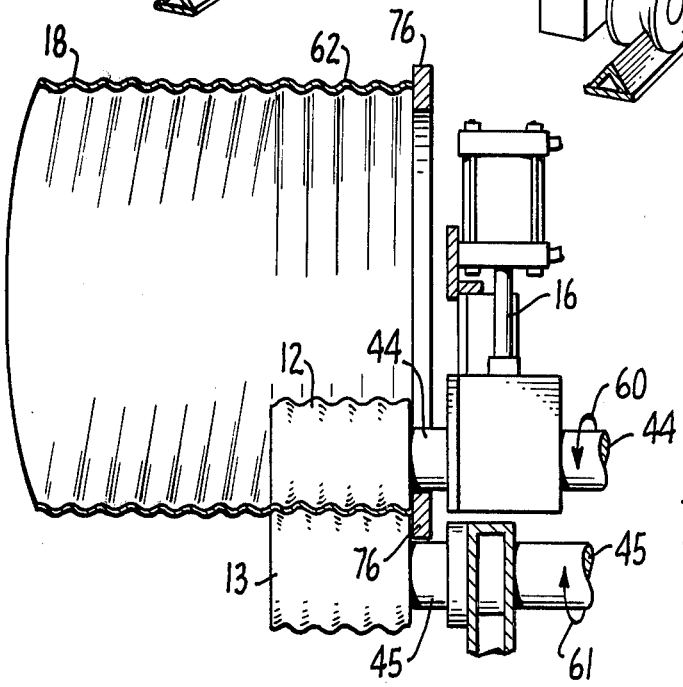
FIG. 2 is a section view taking along lines 2—2 of FIG. 1.

An end recorrugator 10 constructed according to the teachings of the present invention is illustrated by way of reference to FIGS. 1–8. Recorrugator 10 includes a pair of vertically spaced, juxtaposed recorrugating rollers 12, 13. AS illustrated by arrow 14 in FIG. 1, roller 12 is movable downwardly by piston 16 to engage the end of a helically corrugated pipe 18 between the rollers as illustrated in FIG. 2.

End corrugator is mounted on a carriage 20. Carriage 20 has a plurality of wheels such as 22–24 so that the carriage is movable along rails 26, 27. Hydraulic cylinder 28 (FIG. 6) controls the position of carriage 20 along rails 26, 27 and is operable to move the carriage so that the end of pipe 18 is between the rollers and can be engaged thereby.

Carriage 20 also includes a linkage mechanism 30 by which end recorrugator 10 can be raised and lowered. Linkage mechanism 30 includes a pair of lengthwise arms 32, 33. Arm 33 is connected to a pair of links 34, 35 toward the front of carriage 20 and a similar pair of links 36, 37 toward the back of the carriage. Arm 32 is similarly connected to pairs of links such as 38, 39 at the front and rear of the carriage. Hydraulic actuator 40 is connected to a shaft 42 running between arms 32 and 33. Actuator 40 can be actuated to move arms 32, 33 forwardly and rearwardly, causing the pairs of links such as 34, 35 and 36, 37 to raise and lower the carriage.

When carriage 20 has been moved along rails 26, 27 so that roller 13 underlies the end portion of pipe 18 which is to be recorrugated, the carriage can be raised using actuator 40 so that recorrugating roller 13 is in contact with the bottom of the pipe. Roller 12 is then moved downwardly by piston 16 so that the end of pipe 18 is engaged between the rollers.

Rollers 12, 13 are mounted on shafts 44, 45 respectively. Keys 46, 47 prevent rotation of the rollers relative to their mounting shafts. A spur gear 48 is mounted circumferentially about shaft 45 and is engaged with a corresponding spur gear 50 on shaft 52. Shaft 52 is the output shaft of a motor (not shown) in housing 54. Spur gear 50 is also engaged with an idler gear 56 which is further engaged with a spur gear 58 circumscribing shaft 44. Idler gear 56 remains engaged with both gears 50 and 58 as shaft 44 moves up and down. When the motor output shaft 52 is driven, support shafts 44, 45 are operated to drive recorrugating rollers 12, 13.

As illustrated in FIG. 2, shafts 44, 45 are driven in mutually opposite directions as depicted by arrows 60, 61. Driven rollers 12, 13 are in engagement with the end 62 of pipe 18. When the rollers 12, 13 are driven they reform the end 62 of helically corrugated pipe 18 so that the end is recorrugated in an annular fashion. Pipe 18 is guided during the corrugating process by a pair of idler rollers 64, 65.

Roller 64 is mounted on a frame 66 which is pivotably attached to carriage 20 by pin 68. The relative position of idler roller 64 is controlled by jack screw 70. Similarly, idler roller 65 is mounted on pivotal frame 72 whose position is controlled by jack screw 74. The positions of idler rollers 64, 65 can be adjusted to accomodate various diameters of pipe to be recorrugated and each such pipe is maintained in position as it is being recorrugated.

As rollers 12, 13 rotate as illustrated in FIG. 2 to recorrugate the end of pipe 18, the ridged portions of the rollers will tend to follow the helical corrugations already present in the pipe. As a result, the pipe will tend to thread through recorrugating rollers 12, 13 toward the aft end of the end recorrugator. A stop must be provided to prevent axial movement of pipe 18 so that the end thereof will be recorrugated in an annular fashion.

Prior art devices utilized a large stationary plate to prevent axial movement of pipe 18 as it is being recorrugated. Instead of using such a plate, the end recorrugator 10 of the present invention provides an annular thrust ring 76. The marginal portion of thrust ring 76 passes between the support shafts 44, 45 of recorrugating rollers 12, 13. The inner and outer diameters of thrust ring 76 are selected so that the thrust ring is in contact with the end of pipe 18 about its entire diameter.

As illustrated in FIG. 1, a pair of roll platens 80, 81 are located on either side of juxtaposed recorrugating rollers 12, 13. Each roll platen 80, 81 includes an array of coaxial support rollers 82, 83. Rollers 82, 83 are in contact with the surface of annular thrust ring 76 opposite from pipe 18. As a result, when recorrugating rollers 12, 13 are driven to recorrugate the end of pipe 18, annular thrust ring 76 will rotate with the pipe so that relative transverse movement between the pipe and the thrust ring is minimized. Virtually no friction forces will be exerted on the end of the pipe and it will not be damaged.

It is apparent that if support shafts 44, 45 are driven in the direction opposite from that illustrated in FIG. 2, they will act to thread pipe 18 away from the end recorrugator. This would require that annular thrust ring 76 or a similar rotatable stop be located at the far end of the pipe. It is to be understood that such a modification is within the spirit and scope of the present invention.

End recorrugator 10 can be used to recorrugate the ends of pipes of various diameters. However, it is immediately apparent that different diameter thrust rings such as 76 must be employed if the thrust ring is to be in contact with the end of the pipe to be recorrugated about its entire circumference. It may be possible to utilize thrust rings having outer diameters less than the actual diameter of the pipe since the main force exerted on the thrust ring by the pipe occurs at the rollers. It is to be understood that such a modified form of the present invention is within its scope as claimed hereinbelow.

Figure 3:
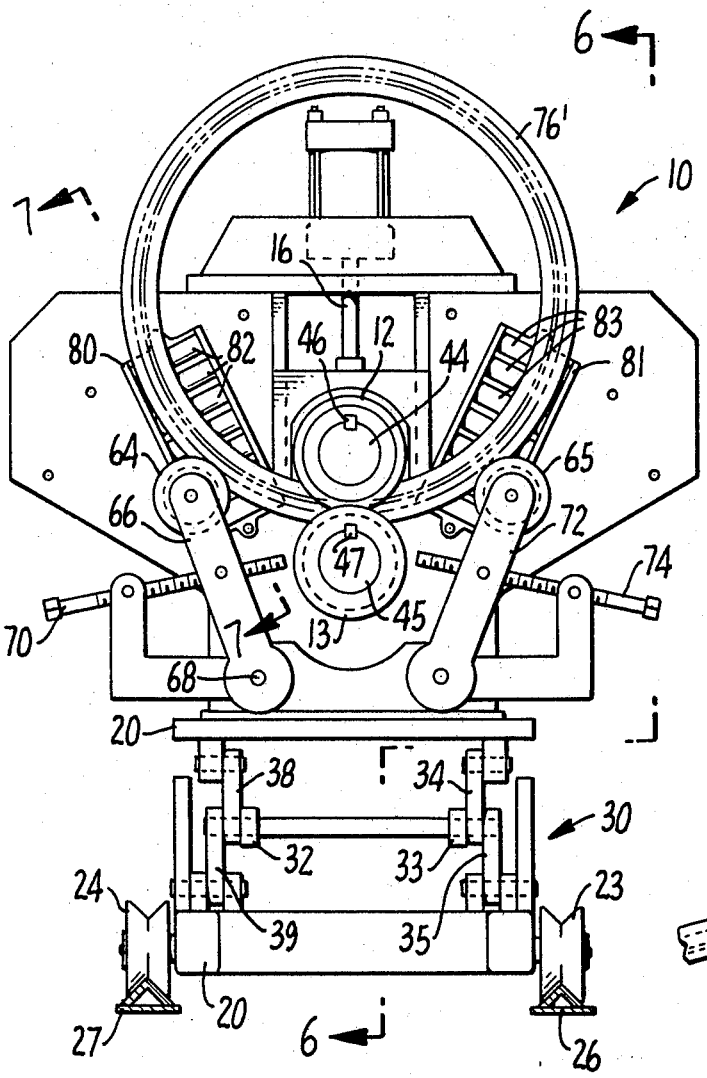
FIG. 3 is an end view of the machine illustrated in FIG. 1.
Figure 4:
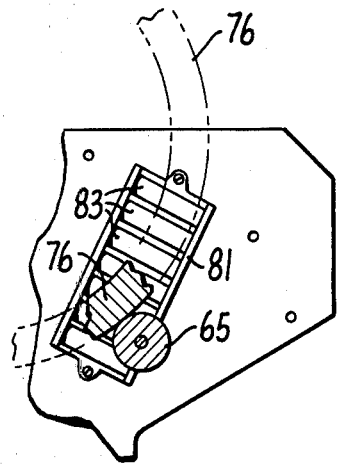
FIG. 4 is a fragmentary view of one of the roll platens of the present invention.
Figure 5:
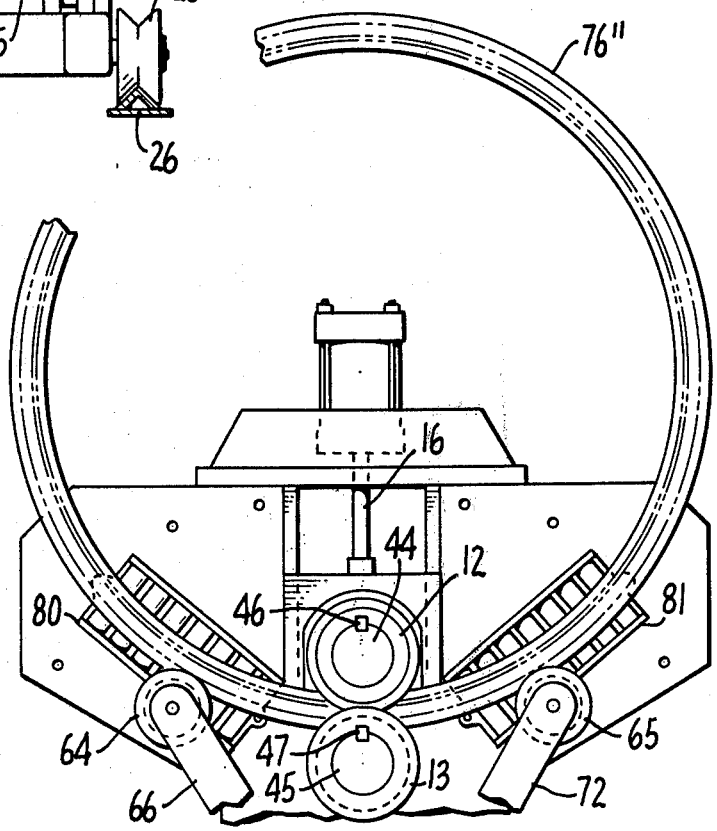
FIG. 5 is an enlarged end view of the machine illustrated in FIGS. 1 and 3 showing the installation of a large diameter thrust ring.
Figure 7:
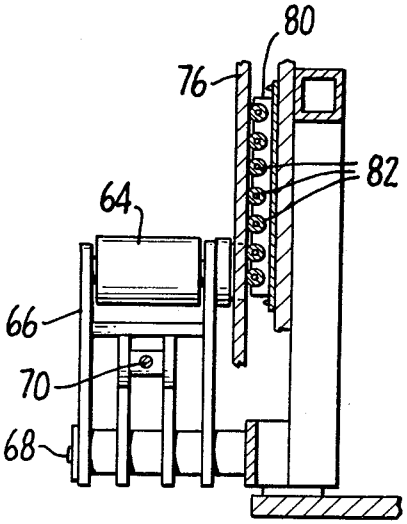
FIG. 7 is a sectional view taken along lines 7—7 of FIG. 3.
Figure 8:
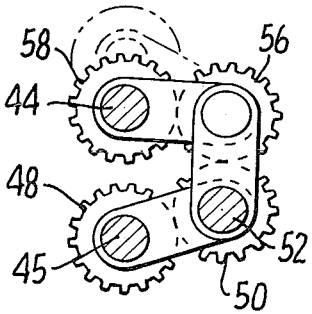
FIG. 8 is a sectional view taking along lines 8—8 of FIG. 6.
Figure 6:
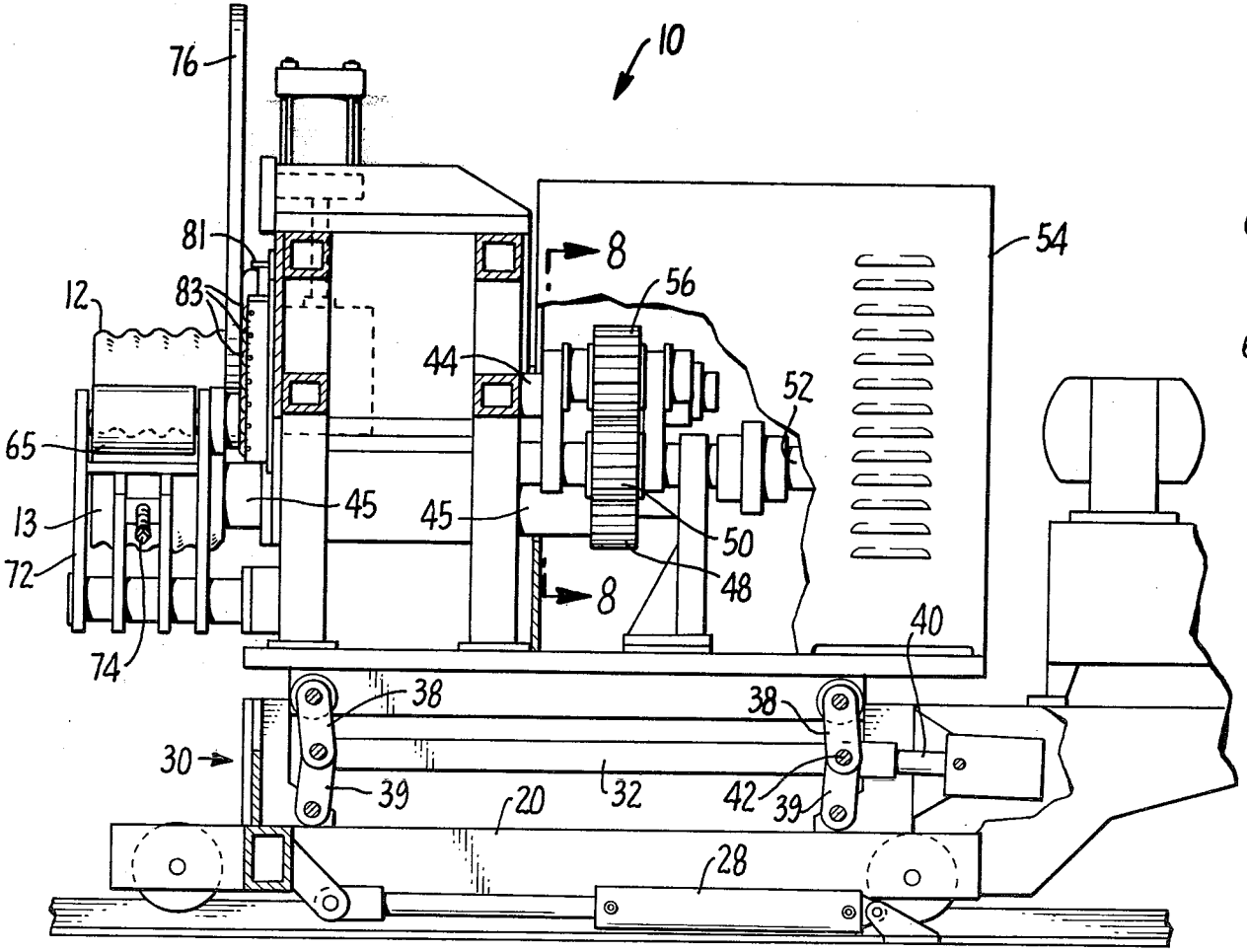
FIG. 6 is a sectional view taken along lines 6—6 of FIG. 3.
Figure 9:
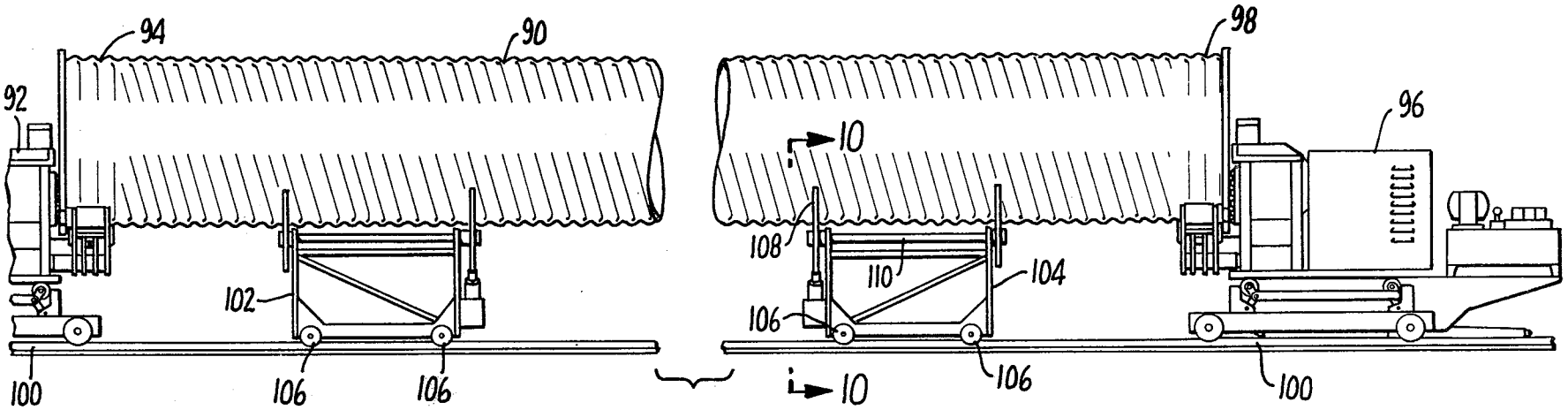
FIG. 9 is an elevation view illustrating the system of the present invention in which both ends of a pipe section are recorrugated simultaneously.

In the preferred embodiment of the present invention as disclosed herein, a plurality of annular thrust rings 76′, 76″ are provided, as illustrated in FIGS. 3–5. Each annular thrust ring 76′, 76″ is designed to be used with a given diameter of helically corrugated pipe to be recorrugated. In each case, the inner diameter of the annular thrust ring is less than the diameter of the corresponding pipe, and the outer diameter is greater than the diameter of the corresponding pipe. In this manner, the end of the pipe to be recorrugated is abutted against thrust ring 76 about its entire circumference.

Two of the end recorrugators illustrated in FIGS. 1–8 can be used simultaneously to recorrugate the two ends of a pipe 90 to be recorrugated, as illustrated in FIGS. 9–12. One end recorrugator 92 is adapted to recorrugate one end 94 of pipe 90, and end recorrugator 96 is adapted to recorrugate end 98. Each end recorrugator 92, 96 rides on rails 100 and discussed previously so that the end recorrugators can be moved inwardly to engage the ends of pipe 90.

As illustrated by way of reference to FIGS. 9–12, a pair of carts 102, 104 are used to move pipe 90 into position between end recorrugators 92, 96. Each cart 102, 104 has a plurality of wheels 106 which ride along rails 100 so that the carts can be positioned at preselected intervals between the end recorrugators to accomodate pipes of various lengths.

Figure 10:
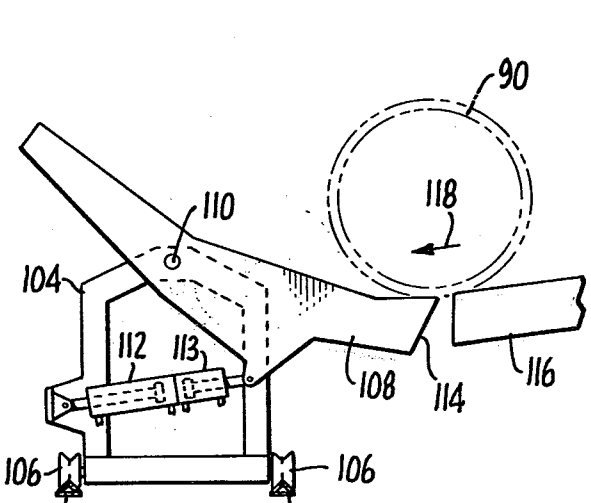
FIG. 10 is a sectional view taken along lines 10—10 of FIG. 9.

The operation of one of the carts 102 in positioning pipe 90 for recorrugation is illustrated by reference to FIGS. 10–12. Cart 102 has a carriage 108 pivotably mounted to the cart at 110. In order to receive pipe 90 to be recorrugated, hydraulic actuators 112, 113 are in their contracted position so that the upstream end of 114 of carriage 108 is aligned with the end 116 of the assembly line for the recorrugated pipe. In this manner, pipe 90 can easily be dispensed onto carriage 108 as illustrated by arrow 118.

Figure 11:
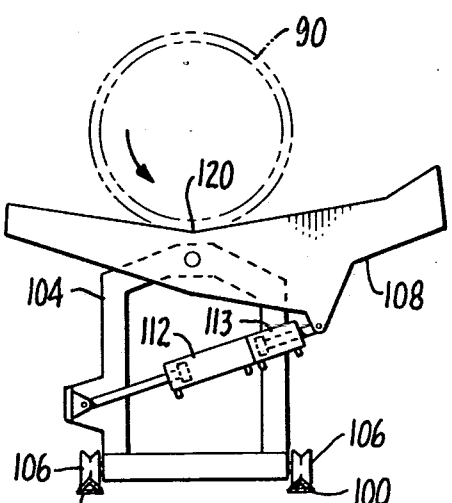
FIG. 11 is a view similar to that of FIG. 10 illustrating the positioning of the pipe for recorrugating.

Pipe 90 is centered on cart 102 by pivoting carriage 108, as illustrated in FIG. 11. Hydraulic actuator 112 is extended so that pipe 90 will settle at the nadir 120 of carriage 108. In this poisition, pipe 90 is engaged by end recorrugators 92, 96 as described previously and lifted off carriage 108 for recorrugation.

Figure 12:
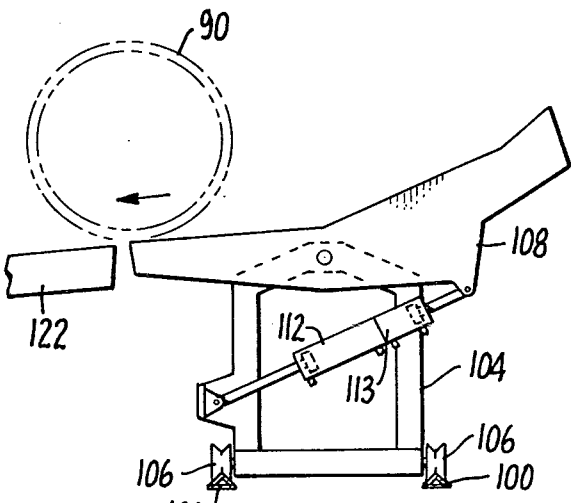
FIG. 12 is a view similar to that of FIGS. 10 and 11 illustrating discharge of the recorrugated pipe.

After the ends of pipe 90 have been recorrugated and the pipe has been disengaged from end recorrugators 92, 96, the pipe is dispensed from cart 102 as illustrated in FIG. 12. Hydraulic actuator 113 is extended to further pivot carriage 108 so that pipe 90 rolls off of the carriage and onto receiving platform 122.

Figure 13:
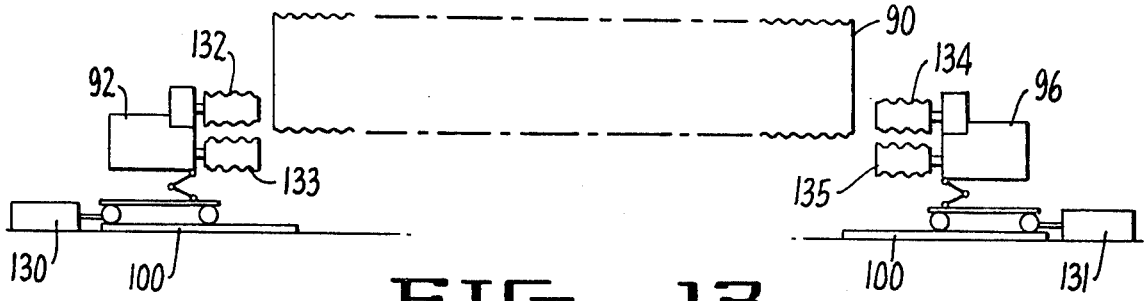
FIGS. 13–17 are sequential views illustrating the operation of the system of the present invention.

The manner in which pipe 90 is engaged by end recorrugators 92, 96 for recorrugation of the ends of the pipe is illustrated by way of reference to FIGS. 13–17 in sequence. As illustrated in FIG. 13, pipe 90 is initially positioned between end recorrugators 92, 96. The end recorrugators have been moved backwardly along tracks 100 by hydraulic actuators 130, 131 so that the pipe can fit between the recorrugators. The recorrugating rolls 132, 133 on end recorrugator 92 and 134, 135 on end recorrugator 96 are spaced apart so that the ends of pipe 90 can fit between the rollers.

Figure 14:
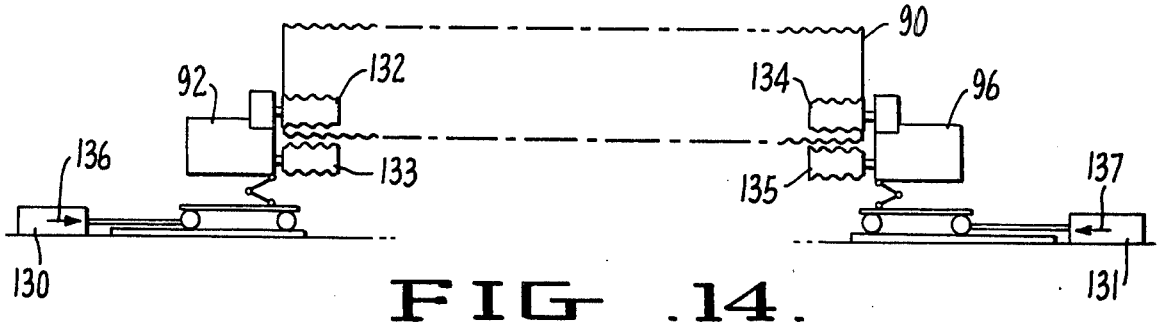
Figure 15:
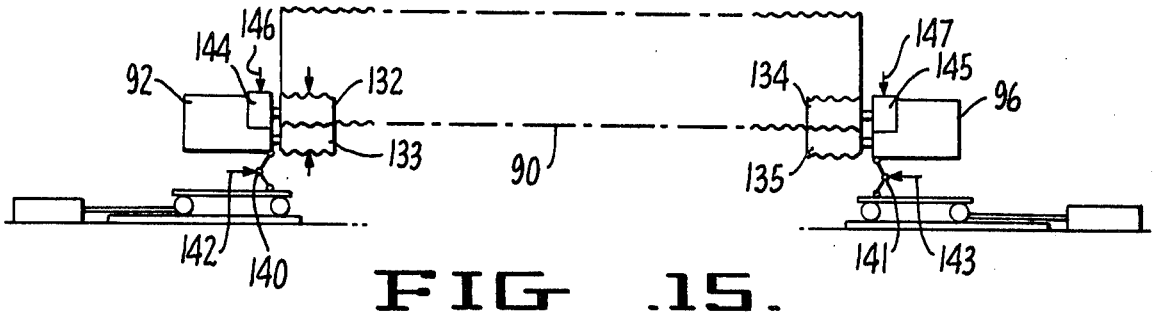

Referring next to FIG. 14, hydraulic actuators 130, 131 are actuated as illustrated by arrows 136, 137 to move end recorrugators 92, 93 inwardly. In this position, the ends of pipe 90 which are to be recorrugated are positioned between rollers 132, 133 on end recorrugator 92 and rollers 134, 135 on end recorrugator 96.

To engage the ends of pipe 90 between the recorrugating rollers, end recorrugators 92, 96 are first raised by extending linkages 140, 141 as illustrated by arrows 142, 143. In this manner, the lower rollers 133, 135 on each end recorrugator are moved upwardly to engage the outer circumference of the pipe. Thereafter, hydraulic actuators 144, 145 are actuated as illustrated by arrows 146, 147 to move upper rollers 132, 134 downwardly. The ends of pipe 90 are thus engaged between the pairs of recorrugating rollers 132, 133 and 134, 135 and the corrugating proceeds as described previously.

Figure 16:
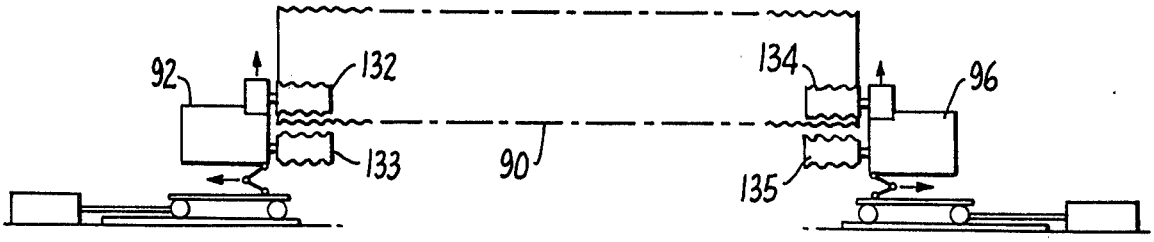
Figure 17:
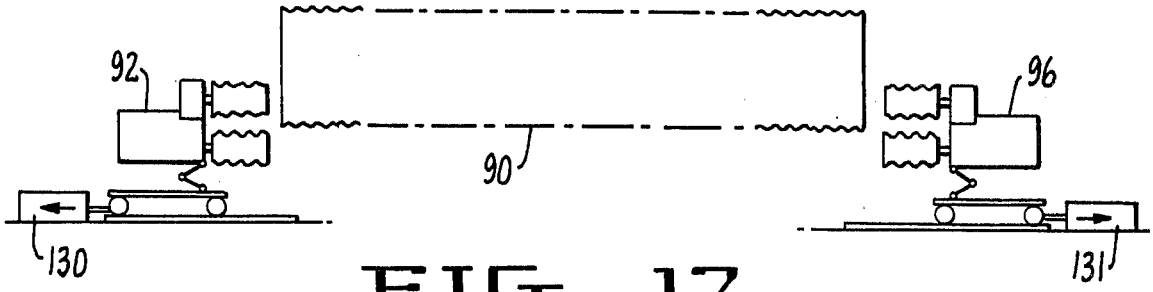

After the ends of pipe 90 have been recorrugated, the corrugating rollers 132, 133 and 134, 135 are separated as illustrated in FIG. 16. End recorrugators 92, 96 are lowered so that pipe 90 is disengaged from the rollers. Hydraulic actuators 130, 131 operate in reverse to move end recorrugators 92, 96 backwardly so that pipe 90 can be removed from between the rollers, as illustrated in FIG. 17.

In operation, the end recorrugators of the present invention recorrugate the ends of the helically corrugated pipe in an annular fashion so that various pipe sections can more readily be joined end to end. The appartatus of the present invention recorrugates the ends of the pipe with a minimum of damage to the pipe by using a rotatable annular thrust ring to prevent axial movement of the pipe. Damage to the pipe is reduced to such an extent that both ends of the pipe can be recorrugated in a single operation as disclosed herein.

While a preferred embodiment of the present invention has been illustrated in detail, it is apparent that modifications and adaptations of that preferred embodiment will occur to those skilled in the art. However, it is to be expressly understood that such modifications and adaptations are within the spirit and scope of the present invention, as set forth in the following claims.

What is claimed is:

1. In a machine for recorrugating a portion of a helically corrugated pipe which comprises a juxtaposed pair of recorrugating rollers between which one end of the pipe to be recorrugated is inserted and the portion thereof to be recorrugated engaged, a pair of rotatable shafts to which the recorrugating rollers are mounted, and means for driving the rollers to recorrugate said portion of the pipe, the improvement comprising a rotatable annular thrust ring having a marginal portion passing between the shafts so that at least a portion of said one end of the pipe is abutted against said thrust ring, and means for mounting said thrust ring to prevent axial movement of the ring and thereby prevent axial movement of the pipe as the pipe is recorrugated, said mounting means including means for allowing rotation of the thrust ring corresponding to the rotation of the pipe as the pipe is being recorrugated to minimize the damage to said one end of the pipe during said recorrugating.

2. A machine as recited in claim 1 wherein the inner diameter of the annular thrust ring is less than the diameter of the pipe and the outer diameter of the annular thrust ring is greater than the diameter of the pipe so that one end of the pipe is abutted against the thrust ring along the entire circumference of said pipe.

3. A machine as recited in claim 1 wherein the mounting means includes a pair of roll platens each including an array of support rollers in abutment wth the annular thrust ring opposite from the pipe to prevent axial movement of the ring.

4. A machine as recited in claim 1 and additionally comprising a pair of idler rollers parallel with the recorrugating rollers and adapted to support said one end of the pipe when not engaged by said recorrugation rollers, and wherein the annular thrust ring is adapted to rest on said idler rollers.

5. A machine as recited in claim 3 and additionally comprising a plurality of annular thrust rings of varying diameters, and wherein the inclination of the roll platens is variable to conform to the diameter of the respective annular thrust rings.

6. In a method for recorrugating an end of a helically corrugated pipe comprising the steps of locating said end of the pipe between a pair of recorrugating rollers mounted on supporting shafts, engaging said end of the pipe with said recorrugating rollers and driving the recorrugating rollers to recorrugate the ends of the pipe, the improvement comprising the steps of abutting at least a portion of said end of the pipe against a rotatable annular thrust ring having a marginal portion passing between the shafts simultaneous with said driving step to prevent axial movement of the pipe in the direction of the helical corrugations while minimizing damage to said end of the pipe.

7. A method as recited in claim 6 wherein said abutting step comprises the step of abutting the entire circumference of said end of the pipe against the rotatable annular thrust ring to prevent axial movement of the pipe in the direction of the helical corrugations.

8. In a machine for recorrugating a portion of a helically corrugated pipe which comprises a juxtaposed pair of recorrugating rollers between which one end of the pipe to be recorrugated is inserted and the portion thereof to be recorrugated engaged, a pair of rotatable shafts to which the corrugating rollers are mounted, and means for driving the rollers to recorrugate said portion of the pipe, the improvement comprising a rotatable annular thrust ring having a marginal portion passing between the shafts so that at least a portion of said one end of the pipe is abutted against said thrust ring, the inner diameter of the annular thrust ring being less than the diameter of the pipe to be recorrugated and the outer diameter of the annular ring being greater than the diameter of the pipe to be recorrugated so that said one end of the pipe is abutted against the thrust ring about the entire circumference of said pipe; and a pair of roll platens each including an array of support rollers in abutment with the annular thrust ring opposite from the pipe to prevent axial movement of the ring.

9. A machine as recited in claim 8 and additionally comprising a plurality of annular thrust rings of varying diameters, and wherein the inclination of the roll platens is variable to conform to the diameter of the respective annular thrust rings.

10. Apparatus for recorrugating the ends of a helical pipe, said apparatus comprising:

a juxtaposed pair of recorrugating machines each having a pair of vertically juxtaposed and spaced recorrugating rollers mounted on shafts and adapted to engage and recorrugate the respective ends of a helically corrugated pipe;

a pair of carriage means supporting the respective recorrugating machines and adapted to move at least one of said machines toward the pipe for engagement of the ends of the pipe with the respective pairs of recorrugating rollers; and a thrust stop including an annular thrust ring having a marginal portion passing between the shafts rotatably mounted to one of the recorrugating machines so that one end of the pipe is at least partially nonrotatably abutted against said stop to prevent axial movement of the pipe in the direction of the helical corrugations as the ends of the pipe are recorrugated without damaging the end of the pipe abutted against the stop.

11. Apparatus as recited in claim 10 wherein the inner diameter of the annular thrust ring is less than the diameter of the pipe to be recorrugated and the outer diameter of the annular thrust ring is greater than the diameter of the pipe so that said one end of the pipe is abutted against the thrust ring along the entire circumference of said pipe.

12. A method of recorrugating the ends of a helically corrugated pipe, said method comprising the steps of:

locating the pipe axially between a pair of recorrugating machines each having a pair of vertically juxtaposed and spaced recorrugating rollers mounted on shafts;

moving at least one of the respective machines inwardly with respect to the pipe so that the ends of the pipe are disposed between the recorrugating rollers of the respective machines;

raising the machines subsequent to said moving step so that the lower of the recorrugating rollers of each machine contacts the outer circumference of the pipe;

depressing the upper of the recorrugating rollers of each machine subsequent to said moving step so that the upper said roler of each machine contacts the inner circumference of the pipe, thereby engaging the ends of the pipe between the rollers of the respective recorrugating machines;

simultaneously driving the recorrugating rollers of the two machines to recorrugate the ends of the pipe; and preventing axial movement of the pipe during said driving step by abutting at least a portion of one end of the pipe against a rotatable annular thrust ring having a marginal portion passing between the shafts.

13. A method as recited in claim 12 wherein said preventing step includes the step of abutting the entire circumference of said one end of the pipe against the rotatable annular thrust ring to prevent axial movement of the pipe in the direction of the helical corrugations.

* * * * *